US008418329B2

(12) United States Patent
Davis et al.

(10) Patent No.: US 8,418,329 B2
(45) Date of Patent: Apr. 16, 2013

(54) URN WITH LATCH

(75) Inventors: Gerald Davis, Fountain City, IN (US); Gary L. Cox, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 28 days.

(21) Appl. No.: 12/815,360

(22) Filed: Jun. 14, 2010

(65) Prior Publication Data

US 2011/0005048 A1 Jan. 13, 2011

Related U.S. Application Data

(60) Provisional application No. 61/186,863, filed on Jun. 14, 2009.

(51) Int. Cl.
*A61G 17/00* (2006.01)

(52) U.S. Cl.
USPC ..... 27/1

(58) Field of Classification Search ..... 27/1; 220/315, 220/833–835, 837, 4.22, 4.23
See application file for complete search history.

(56) References Cited

U.S. PATENT DOCUMENTS

| | | | | |
|---|---|---|---|---|
| 4,079,880 | A * | 3/1978 | Edwards | 220/4.21 |
| 4,989,744 | A * | 2/1991 | Tominaga | 220/835 |
| 5,037,000 | A * | 8/1991 | Selame | 221/303 |
| 7,373,702 | B1 * | 5/2008 | Vonderheide | 27/1 |
| 2004/0134910 | A1 * | 7/2004 | Colombo | 220/4.23 |
| 2005/0125973 | A1 * | 6/2005 | Hankel et al. | 27/1 |
| 2006/0207075 | A1 * | 9/2006 | Davis | 27/1 |
| 2010/0011549 | A1 * | 1/2010 | Thompson | 27/1 |

* cited by examiner

*Primary Examiner* — William L. Miller
(74) *Attorney, Agent, or Firm* — Maginot, Moore & Beck

(57) ABSTRACT

A cremation urn includes a base and a lid. The base has a wall defining an opening through the wall. The wall has an internal surface and an external surface. The wall defines a rim. The lid includes a cover for engagement with the base and an integral catch. The catch includes a protrusion extending from the cover and sized to fit into the opening to selectively secure the lid to the base. The protrusion includes a wall engaging surface for engaging the wall and an external surface extending from the wall engaging surface in a direction opposed to the cover, the wall engaging surface having a width less than a length of the external surface in a direction opposed to the cover.

20 Claims, 6 Drawing Sheets

URN WITH LATCH

This application claims the benefit of U.S. Provisional Patent Application Ser. No. 61/186,863, filed Jun. 14, 2009, which is incorporated herein by reference.

FIELD

This application relates generally urns for containing cremated ashes, and more specifically to urns used to securely store ashes.

BACKGROUND

Remains of deceased individual are typical embalmed and/or cremated. While cremated remains may be scattered, the cremated remains are often stored in urns. In some cases, the remains may be transported substantial distances from the crematory to the final resting or scattering place of the remains. The safe and undisturbed storage of the remains in the urn is an important consideration. An urn that in not prone to unintentional opening and that safely secures the remains is desired. Therefore, it would be advantageous to provide an urn that safely secures cremated remains.

SUMMARY

The present invention addresses the above consideration by providing a secure cremation urn that can be created from inexpensive materials, such as injected molded plastic.

According to one embodiment of the present disclosure, a cremation urn includes a base and a lid. The base has a wall defining an opening through the wall. The wall has an internal surface and an external surface. The wall defines a rim. The lid includes a cover for engagement with the base and an integral catch. The catch includes a protrusion extending from the cover and sized to fit into the opening to selectively secure the lid to the base. The protrusion includes a wall engaging surface for engaging the wall and an external surface extending from the wall engaging surface in a direction opposed to the cover, the wall engaging surface having a width less than a length of the external surface in a direction opposed to the cover.

According to another embodiment of the present disclosure, there is provided a cremation urn including a base and a lid. The base has a wall with an inner surface and an opposed outer surface defining a thickness between the inner surface and the outer surface. The wall defines a rim extending from the outer surface to the inner surface. The wall further defines an opening extending from the outer surface to the inner surface. The opening of the wall is spaced from the rim a distance at least three times the thickness of the wall. The lid includes a top and an integral catch extending from the periphery of the top. The catch includes a protrusion sized to fit into the opening to selectively secure the lid to the base.

According to yet another embodiment of the present disclosure there is provided a cremation urn having a base, a lid and living hinge connecting the lid to the base. The base has a wall defining an opening through the wall. The wall has an internal surface and an external surface that defines a thickness between the internal surface and the external surface. The opening of the wall is spaced from a rim of the wall a distance at least three times the thickness of the wall. The lid includes a cover for engagement with the base and an integral catch. The catch includes a protrusion extending from the cover and sized to fit into the opening to selectively secure the lid to the base. The protrusion includes a wall engaging surface for engaging the wall and an external surface extending from the wall engaging surface in a direction opposed to the cover. The wall engaging surface having a width less than a length of the external surface in the direction opposed to the cover. The living hinge extends from the lid to the base and is opposed to the catch.

Other technical advantages of the present invention will be readily apparent to one skilled in the art from the following figures, descriptions and claims.

BRIEF DESCRIPTION OF THE DRAWINGS

For a more complete understanding of the present invention and the advantages thereof, reference is now made to the following description taken in connection with the accompanying drawings, in which.

DETAILED DESCRIPTION OF THE PREFERRED EMBODIMENTS

Figure 1:
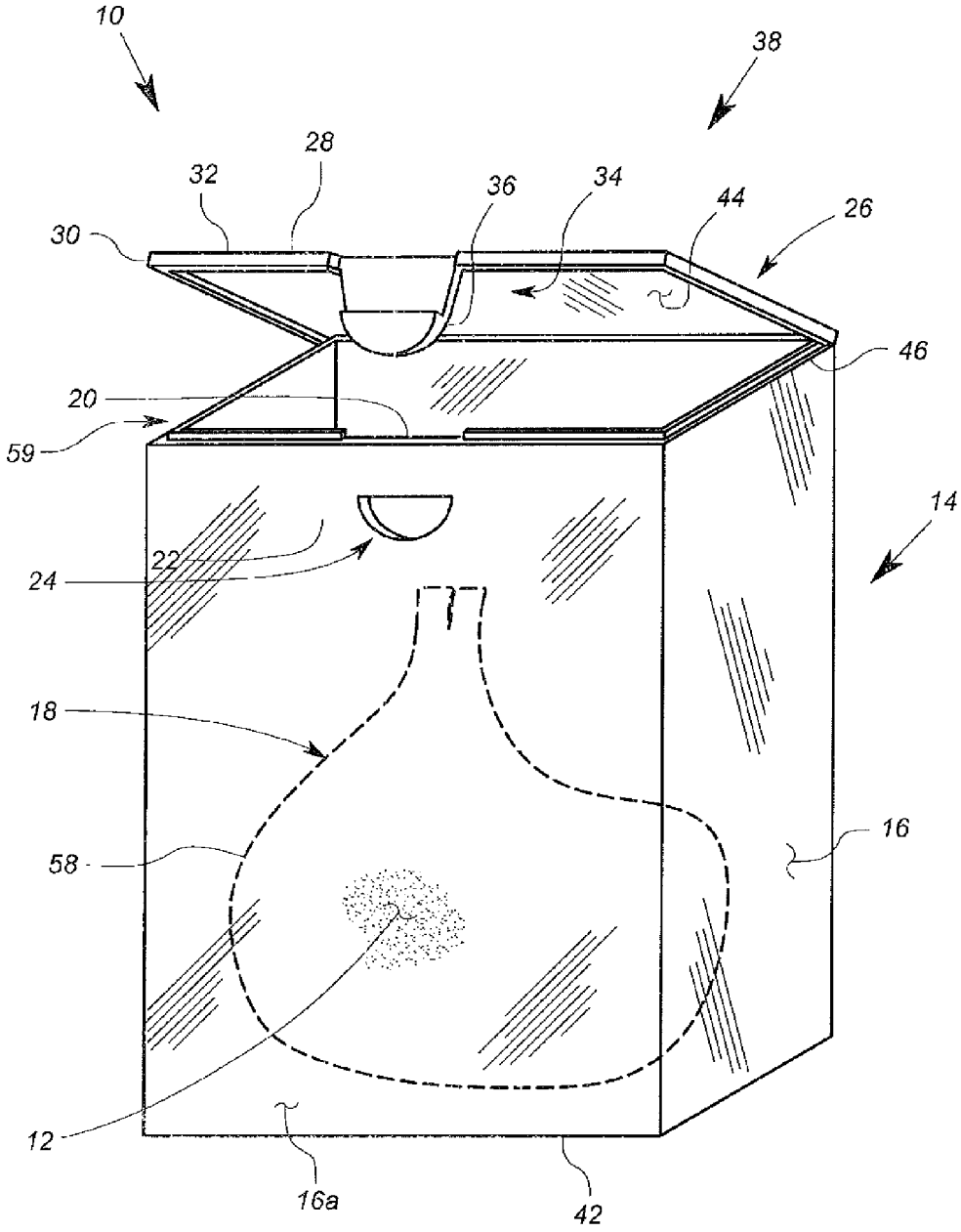
FIG. 1 is a perspective view of an urn with a base, a lid and a catch, showing the catch released from the base, according to an exemplary embodiment of the present disclosure.
Figure 2:
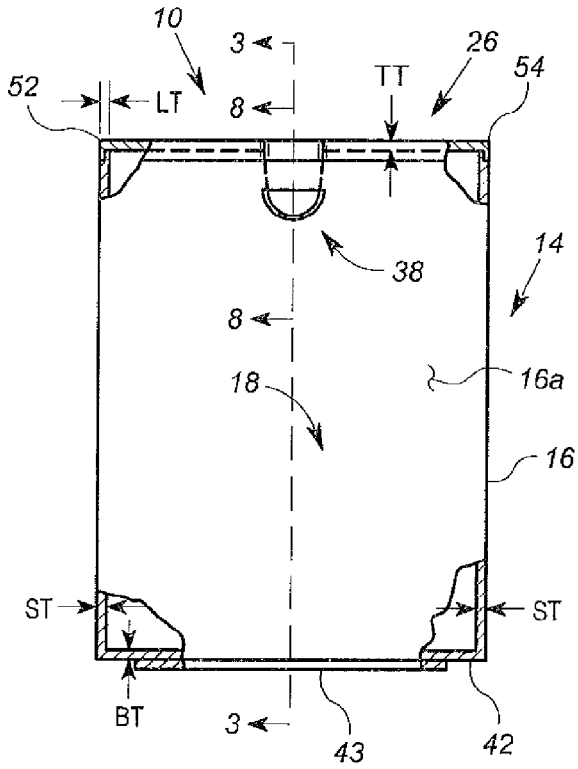
FIG. 2 is a plan view, partially cut away, of the urn of FIG. 1.
Figure 3:
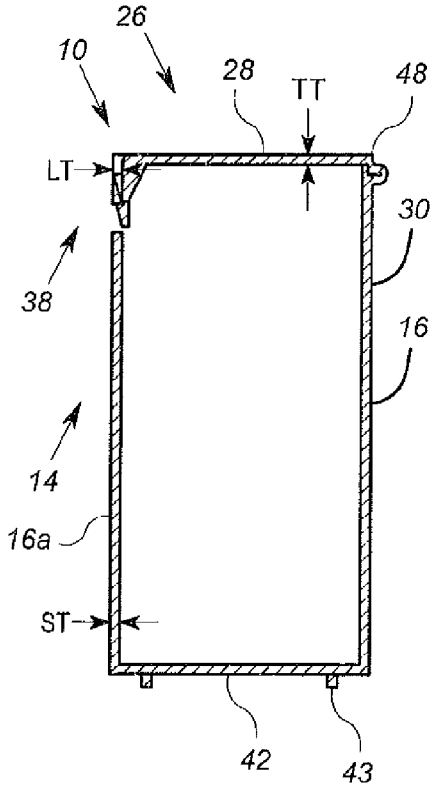
FIG. 3 is a cross-sectional view of FIG. 2 along the line 3-3 in the direction of the arrows.
Figure 4:
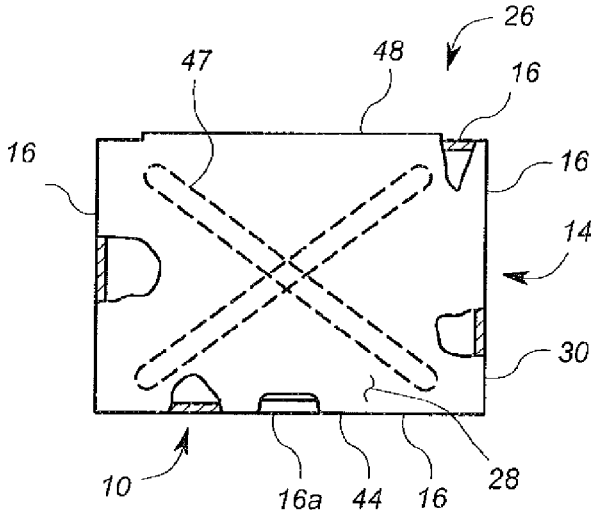
FIG. 4 is a top plan view, partially cut away, of the urn of FIG. 1.

According to the present disclosure and referring now to FIGS. 1-9 an exemplary embodiment of a cremation urn 10 for storing ashes 12 is shown. As shown in FIG. 1, the urn 10 includes a base 14 having a plurality of walls 16, **16*a* defining a cavity 18 in the base 14 for storing ashes 12. Each wall 16 has an inner surface 20 and an opposed outer surface 22. One wall, designated herein as the front wall 16*a*, defines an opening 24 extending from the inner surface 20 to the outer surface 22. The urn 10 also includes a lid 26 having a top 28 of the lid 26 and a lip 30 extending from a periphery 32 of the top 28. The lid 26 has a catch 34 extending from periphery 32 of top 28. The catch 34 has a protrusion 36 sized to fit into the opening 24 of the wall 16*a* of the base 14 to selectively secure the lid 26 to the base 14. The catch 34 and the opening 24 serve to form a latch 38 for securing the lid 26 in a closed position against the base 14**.

As shown in FIGS. 2-5, the base 14 in the exemplary embodiment has the general shape of an open box, wherein the four side walls 16, **16*a* are general planar in shape with a thickness ST. The walls 16, 16*a* extend vertically upwardly from a rectangular bottom wall 42. The bottom wall 42 has a suitable bottom thickness BT. In an exemplary embodiment, the side thickness ST and the bottom thickness BT may be the same. The side thickness ST and the bottom thickness BT may be uniform or vary within the base 14** and may, for example, be from about 0.05 inches to about 0.3 inches.

The side walls 16, 16*a* and bottom wall 42 have sufficient size such that the cavity 18 is capable of holding ashes of one or two deceased. The bottom wall 42 may include support ribs 43 for stiffening. The support ribs 43 may, as shown, form a rectangle. While the base in this embodiment is generally a rectangular in shape, the base 14 may alternatively be cylindrical or have any other geometric or non-geometric shape.

Referring again to FIG. 1, the lid 26 has a generally rectangular shape and is configured to align with the base 14 to cover the cavity 18. The top wall 28 of the lid 26 in this embodiment is generally planar. Depending on the configuration of the base 14, the top wall 28 may have other shapes. The top wall 28 may also be non-planar, instead being arcuate or domed. The top wall 28 includes the lip 30 extending downwardly from the periphery 32 of top wall 28. The lip 30 serves to strengthen the lid 26, and also forms a fit over a corresponding rim 46 of the base 14. Moreover, the underside of the top wall 28 adjacent the lip 30 includes an inner face 44 which mates with, or at least nearly mates with a top of the rim 46 of the base 14. The lip 30 extends continuously around the periphery 32, except for a portion of the lip 30 adjacent the catch 34. The lip 30 also mates with a recess 59 adjacent to and defined by the rim 46 of the base 14. A seal (not shown) may be placed between the inner face 44 and the rim 46 and/or between the recess 59 and the lip 30 to seal the contents within the cavity 18 of the urn 10.

Referring to FIGS. 3-4, 8 and 9, the top wall 28 may have a suitable top thickness TT. The top thickness TT may, for example, be from around 0.05 inches to around 0.3 inches. The lip 30 of the lid 26 may suitably have the same thickness as the top thickness. The top wall 28 of the lid 26, as shown, includes top ribs 47 for reinforcing the top wall 28. The top ribs 47 may have any suitable shape and, as shown, have a rectangular cross section and form an "X" and extend inwardly from inner face 44 of the top 28 of lid 26.

Figure 5:
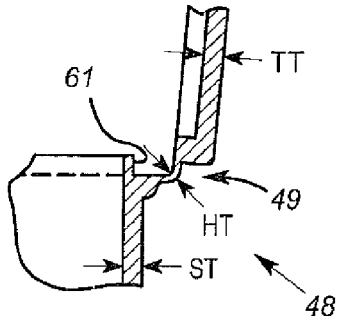
FIG. 5 is a partial cross-sectional view of the living hinge of the urn of FIG. 1, showing the lid in an opened position.

As shown in FIG. 5, the lid 26 is connected to the base 14 by a hinge 48. As shown, the hinge 48 is extends outwardly from side 16 of base 14 below recessed shoulder 61 of base 14. As shown, the hinge 48 is a so-called "living hinge", formed by molding an area of thinner plastic, thus creating a deformable length of plastic that operates as a hinge. Accordingly, the hinge 48 includes a section 49 of reduced thickness, for example hinge thickness HT. The hinge thickness HT may be for example from 60 percent to 10 percent of the top thickness TT or the side thickness ST. The hinge 48, therefore, is integrally formed with the lid 26 and the base 14.

The urn 10 as described above may be constructed of a polymer that is molded to form an integral unit including the base 14, the lid 26, the living hinge 48 and the latch 38. The polymer may, for example, be polyurethane, polypropylene, polystyrene, polycarbonate, Santoprene®, or polyethylene. While a single continuous hinge 48 is shown in this embodiment, the lid 26 may alternatively be connected to the base 14 by at least one additional latch (not shown), similar to latch 38.

Figure 6:
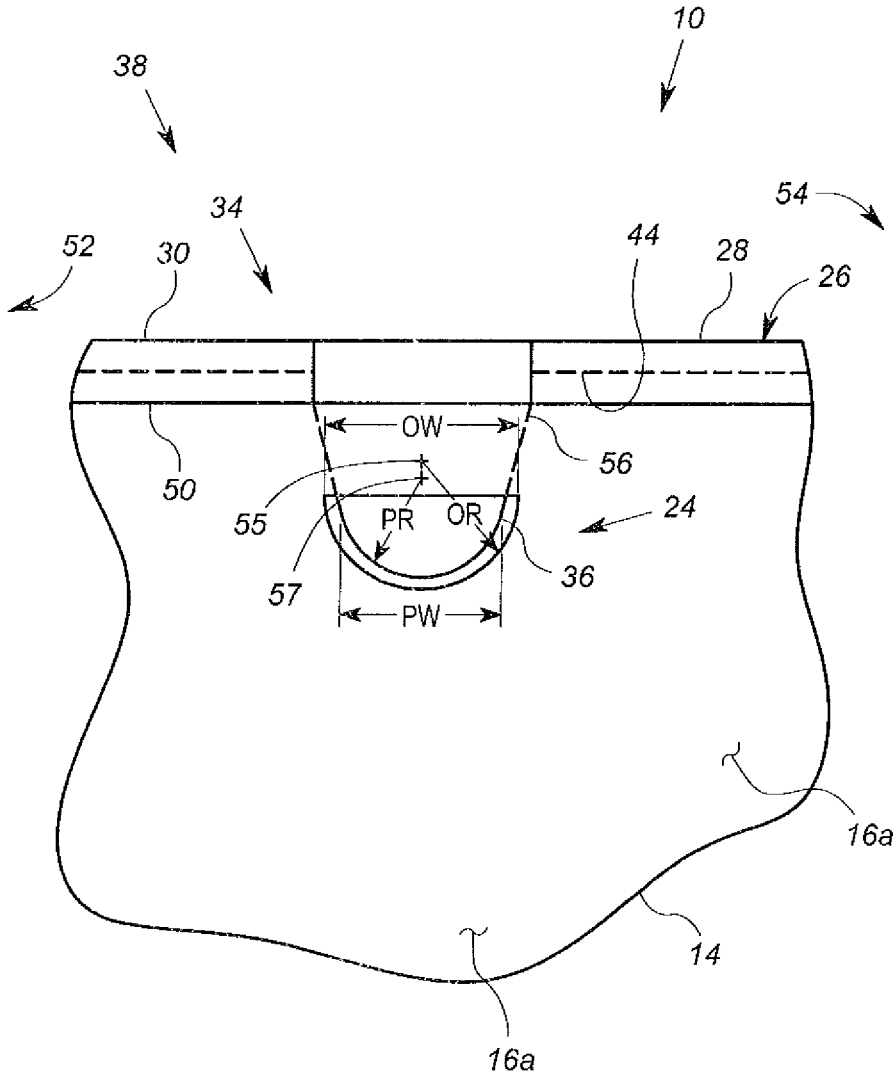
FIG. 6 is a partial plan view of the latch of the urn of FIG. 1 in engagement with an opening in the base of the urn.

Referring now to FIG. 6, the catch 34 and its interaction with the opening 24 of wall 16 of the base 14 is shown in further detail. The catch 34 and the opening 24 form the latch 38. The catch 34 is positioned centrally between first end 52 of lip 30 of lid 26 and second end 54 of lip 30 of lid 26. The catch 34 includes an arm 56 extending downwardly from lower edge 50 of lip 30 of lid 26. The protrusion 36 extends outwardly from the arm 56. As shown, the arm 56 is wider at the lip 30 of lid 26 and is narrower at protrusion 36.

From the front perspective shown in FIG. 6, the protrusion 36 has a shape conforming to the opening 24 in wall 16 of the base 14. For example, in the embodiment shown, the opening 24 has a semicircular shape defined by an opening width OW and an opening radius OR extending from origin 55. Similarly, the protrusion 36 has a semicircular shape defined by a protrusion width PW and a protrusion radius PR extending from origin 57. The protrusion width PW is slightly smaller than the opening width OW and the protrusion radius PR is slightly smaller than the opening radius OR. The dimensions PR and PW may be selected of a suitable size to cooperate with a person's fingers. Any other shape of the protrusion and the opening such as square, rectangular, or other geometric and non-geometric shapes can be used.

Figure 8:
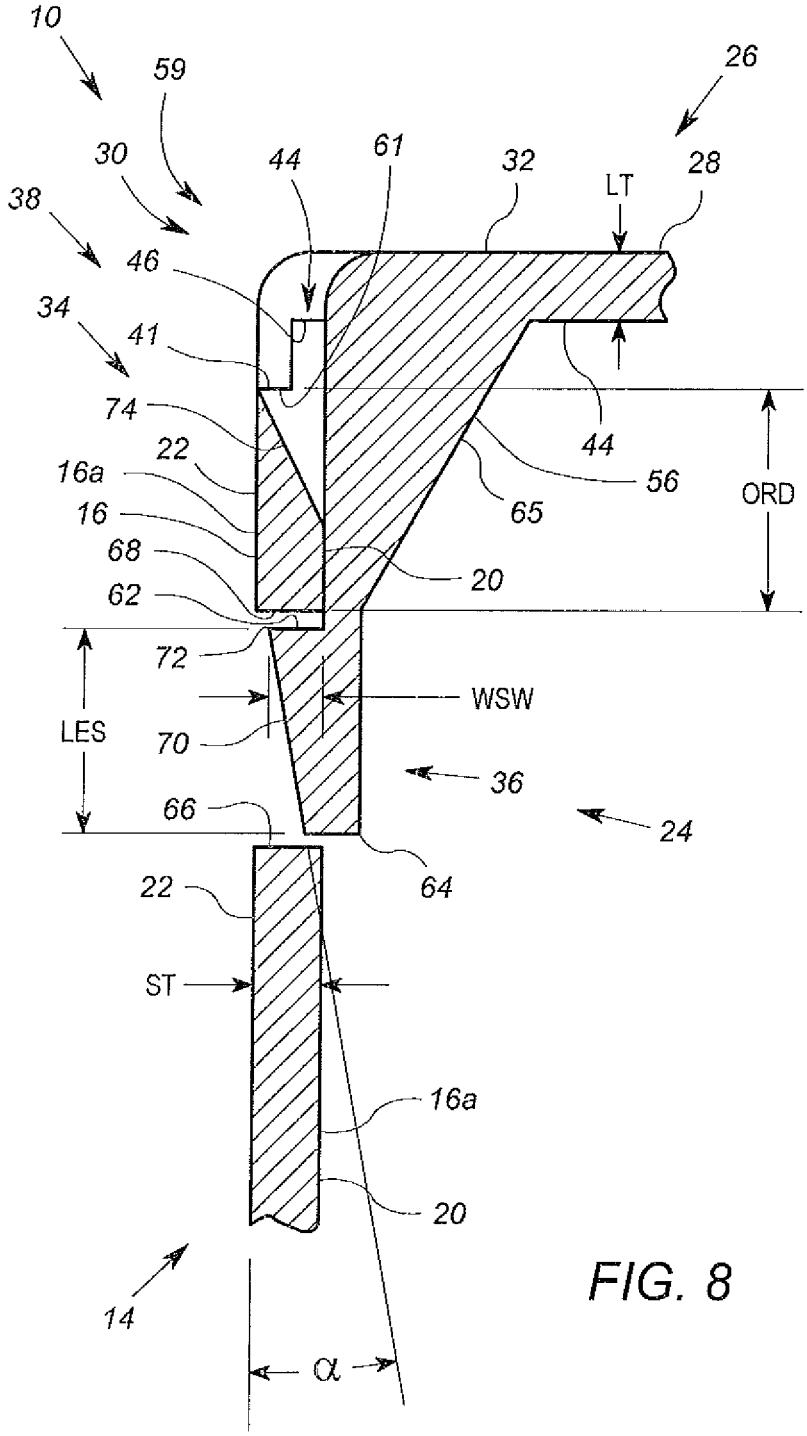
FIG. 8 is a partial cross section view of the urn of FIG. 2 along the line 8-8 in the direction of the arrows showing the catch in cooperation with the opening of the urn to form the latch.
Figure 9:
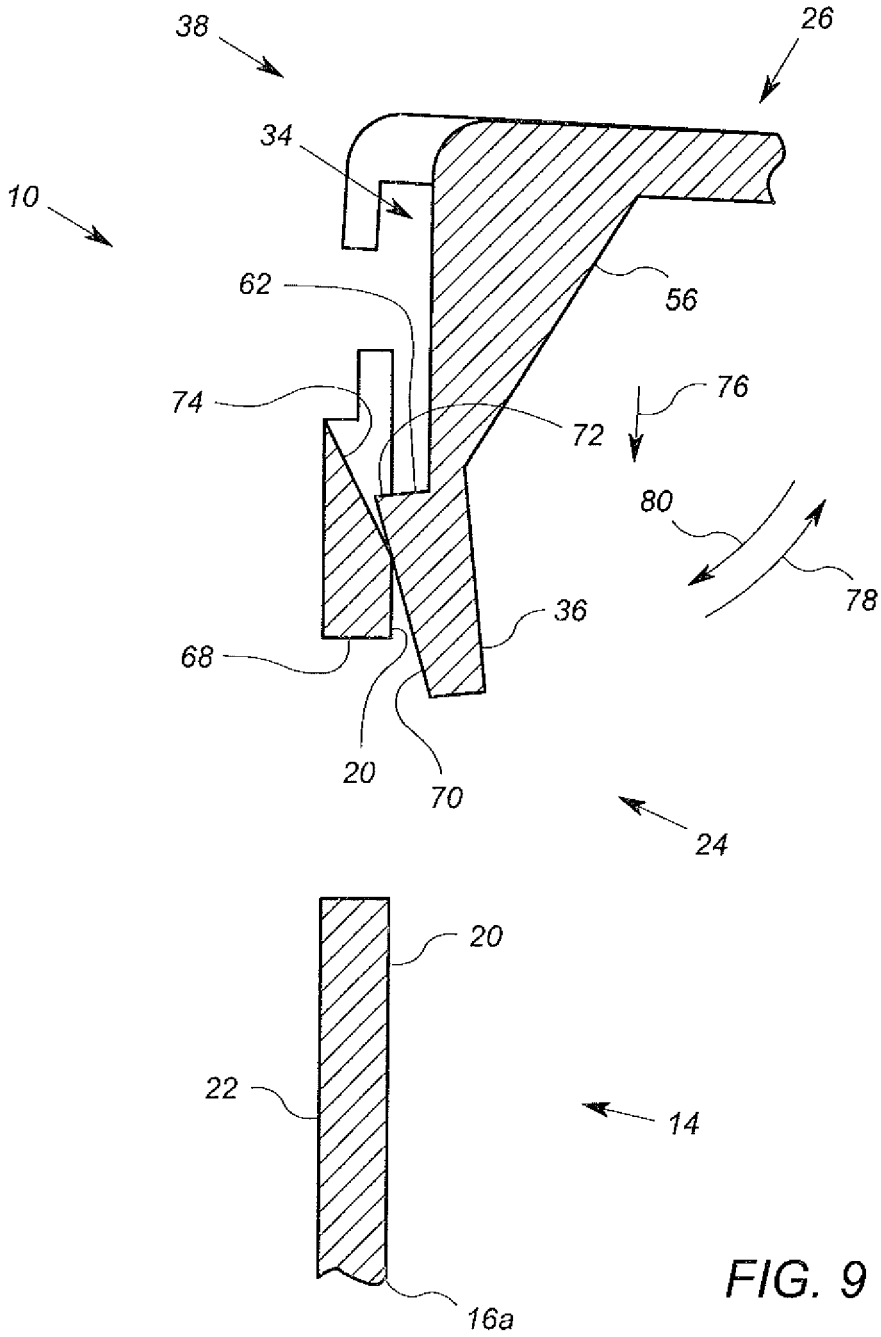
FIG. 9 is a partial cross section view of the urn of FIG. 1 showing the catch of the lid in contact with the base, yet spaced from the opening of the base; and Corresponding reference characters indicate corresponding parts throughout the several views. Like reference characters tend to indicate like parts throughout the several views.

In the embodiment described herein, the catch 34 and opening 24 have further features that are more visible in a side view and/or cross section, such as shown in FIGS. 8 and 9. Further detail regarding these features is provided below in connection with FIGS. 8 and 9.

Figure 7:
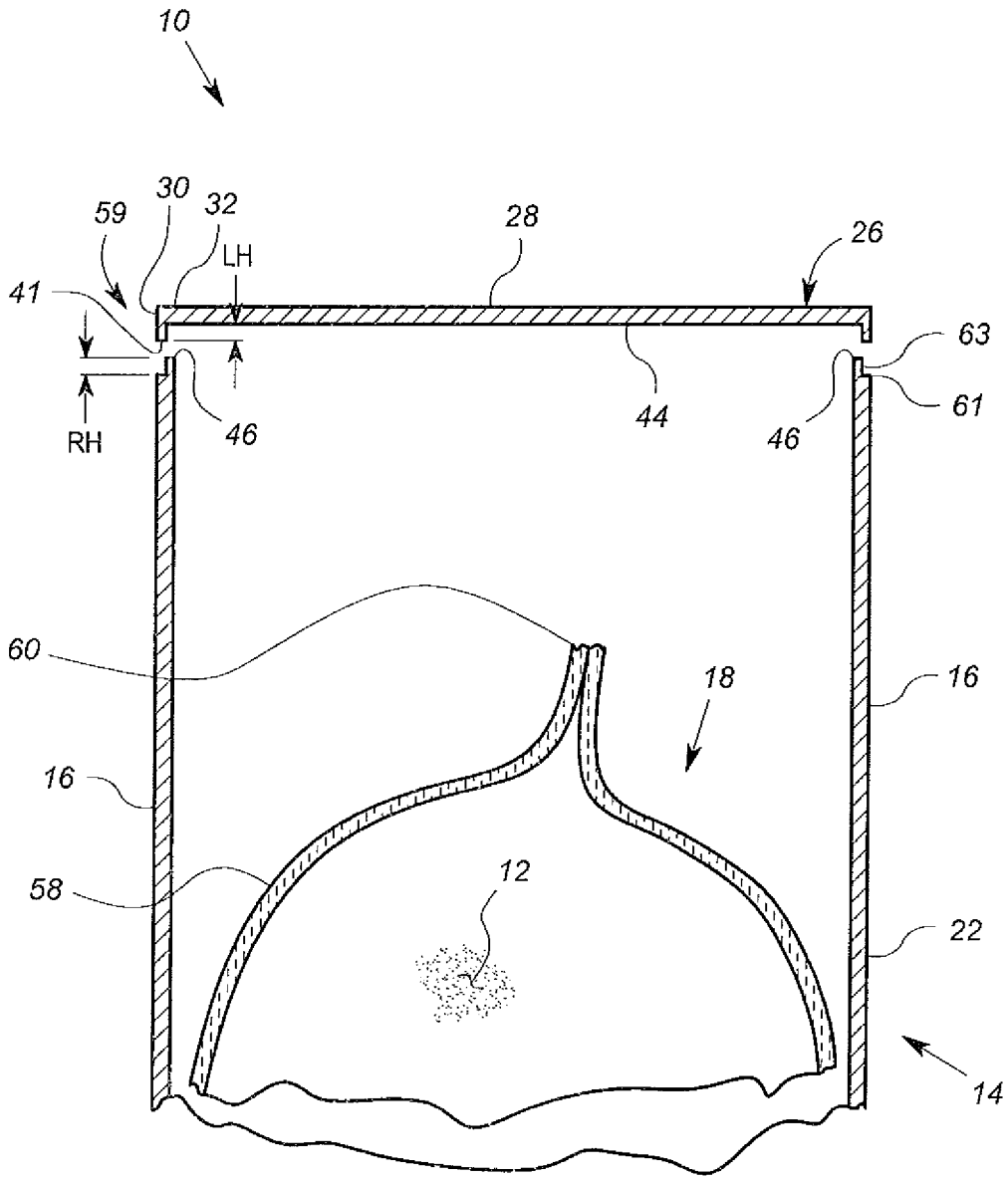
FIG. 7 is a partial cross section view of the urn of FIG. 1 showing the lip of the lid positioned adjacent the rim of the base.

Before proceeding with the discussion of the details shown in FIGS. 8 and 9, a discussion of FIG. 7 is provided. FIG. 7 shows the shape of the lip 30 covering the rim 46 of the base 14 of the exemplary embodiment of the urn 10 in cross section. The lip 30 closely conforms to recess 59 formed in sides 16, 16*a* of base 14 when the lid 26 is closed onto the base 14. The recess 59 is formed between recessed shoulder 61 of sides 16, 16*a* and a side wall 63 of the rim 46. The recessed shoulder 61 defines an upper edge of the sides 16, 16*a*, and defines a base from which the rim 46 extends. The rim 46 defines a top edge of each of the sides 16, 16*a*. The lip 30 extends downwardly from periphery 32 of top 28 of lid 26 a lip height LH that corresponds to recess height RH of the recess 59. The lip 30 further mates with the recess wall 63 of sides 16, 16*a* of the base 14. The lip height LH and the recess height RH are chosen to assist in securing the ashes 12 in the cavity 18 formed in base 14. An additional seal (not shown) may be positioned between the lip 30 and the recess 59 of sides 16, 16*a*.

The ashes 12 may be further secured in an inner container 58 positioned in the cavity 18. The inner container 58 may be secured to the base 14 or be unrestrained within the cavity 18. The inner container 58 may be a plastic bag and may include an integral seal 60 or separate seal, not shown.

Referring now to FIG. 8, the lid 26 is shown in cross section closed upon the base 14 with the latch 38 secured. The arm 56 extends downwardly from inner face 44 of top 28 of lid 26. The arm 56 includes a reinforcement 65 that extends downwardly from inner face 44 of top of lid 26 and that is centrally positioned in the arm 56. As shown, the reinforcement 65 is in the form of a rib or gusset. Alternatively, several spaced apart reinforcements or ribs 65 may be used. It should be appreciated that the rib 56 may be omitted if the catch 34 has sufficient thickness to provide rigidity to the catch 34 to secure the catch 34 in the opening 24. The protrusion 36 extends downwardly from the arm 56 and cooperates with the opening 24 to secure the lid 26 to the base 14. The protrusion 36 includes an upper surface 62 and an opposed lower surface 64. The lower surface 64 is arcuate and defined by radius PR (see FIG. 6). The lower surface 64 may closely conform to arcuate lower wall 66 in side 16*a* of base 14. The upper surface 62 is planar and cooperates to form an interference fit with planar upper wall 68 in side 16*a* of base 14. The walls 66 and 68 define opening 24.

The upper wall 68 in side 16*a* closely conforms to upper surface 62 of protrusion 36. The upper wall 68 and the upper surface 62 may be in an interference fit with each other to urge at least one of the lower face 41 of lip 30 of lid 26 into engagement with the recessed shoulder 61 of recess 59 of sides 16, 16*a* and the inner face 44 of the top 28 of lid 26 into engagement with rib 46 of sides 16, 16*a* of base 14. The interference fit may be configured to compress a seal (not shown) placed between the rim 46 and inner face 44 and/or between the recessed shoulder 61 and the lower face 41. The interference fit is selected to provide only minimal deflection or stress upon the protrusion 36 and arm 56 of catch 34. The protrusion 36 includes an outer face 70 tapered downwardly and inwardly at an angle α from outer surface 22 of side 16*a* of base 14. The outer face 70 has an outer upper end 72 in alignment with or slightly recessed from the outer surface 22 of side 16*a* of base 14. The portion of the wall 16*a* that is disposed above the opening 24 includes an inner surface 74 that is inclined to cooperate with the surface 70 of the arm 56 to limit the inward movement of the protrusion 36 when the protrusion is moved toward (or away from) the opening 24.

To reduce the stress on the arm 56 and the protrusion 36, the arm 56 and the protrusion 36 may be in a non-deflected or relaxed state between the outer surface 74 of arm 56 and the inner surface 20 of the wall 16 of base 14 when the protrusion is positioned in the opening 24. The protrusion 36 is recessed in the opening 24 of base 14 when engaged with opening of the base 14 to prevent inadvertent release of the latch 38 and unintentional opening of the lid 26. This configuration of the latch 38 protects the ashes 12 in the urn 10 from unintentional disruption.

As shown in FIG. 8 and according to an embodiment of the present disclosure, the external surface 70 of the protrusion 36 has a length LES which is greater than width WSW of the upper surface 62 of the protrusion 36. In a preferred embodiment the length LES is at least twice the width WSW and in another preferred embodiment the length LES is at least three times the width WSW. In a particular embodiment the width WSW is approximately 0.06 inches and the length LES is approximately 0.37 inches. Each of these embodiments having one of the defined relationships of the length LES to the width WSW of the protrusion 36 provides the latch 38 of the urn 10 with a catch 34 that provides a sufficient mechanical advantage so that it may be easily deflected with a person's finger to engage and disengage the latch 38 while providing the arm 56 of the catch 34 with sufficient strength to keep the latch 38 engaged, even when the latch 38 of the urn 10 is subjected to a variety of jars and tumbles while transporting the urn 10 over great distances.

Further, as shown in FIG. 8 and according to an embodiment of the present disclosure, the opening 24 is spaced from the rim 46 of the base 14. In fact according to a preferred embodiment and as shown in FIG. 8, the opening 24 is spaced from recessed shoulder 61 of the base 14 a distance ORD defined as the distance from the recessed shoulder 61 to the wall engaging surface 68 of the wall 16. According to a further preferred embodiment, the opening 24 is spaced from the rim 46 of the base 14 the distance ORD which is greater that the thickness ST defined as the distance from inner wall surface 20 to outer wall surface 22 of the wall 16. In a preferred embodiment the distance ORD is greater to twice the thickness ST, in another preferred embodiment the distance ORD is greater to three times the thickness ST, and in another preferred embodiment the distance ORD is greater to eight times the thickness ST. In a particular embodiment the distance ORD is approximately 0.75 inches and the thickness ST is approximately 0.10 inches. Each of these embodiments having one of the defined relationships of the distance ORD between the opening 24 and the recessed shoulder 61 to the thickness ST of the wall 16 provides the latch 38 of the urn 10 with a catch 34 that provides a sufficient mechanical advantage so that it may be easily deflected with a person's finger to engage and disengage the latch while providing the arm 56 of the catch 34 with sufficient strength to keep the latch 38 engaged, even when the latch 38 of the urn 10 is subjected to a variety of jars and tumbles while transporting the urn 10 over great distances.

Referring now to FIG. 9, the lid 26 is shown in a partially closed configuration with the outer face 70 of protrusion 36 in contact with inner surface 20 of wall 16 of base 14. As the lid 26 is further advance in the direction of arrow 76, the protrusion 36 is deflected in the direction of arrow 78 until the outer upper end 72 of protrusion 36 enters opening 24 in wall 16. At that point the protrusion 36 moves in the direction of arrow 80 while the protrusion 36 is further advance in the direction of arrow 76 until upper surface 62 of protrusion 36 engages upper wall 68 of opening 24 while outer face 74 of arm 56 nears inner surface 20 of wall 16. At this point the latch 38 is secured and the protrusion 36 is fully seated in opening 24 with the protrusion 36 and arm 56 in a partially relaxed or low stress state. As can be seen in FIG. 9, the inclined surfaces 70 and 74 to allow initiation of the bending process and gradual increase thereof before the protrusion 36 snaps into place in the opening 24.

Of course, numerous other adaptations are possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A cremation urn, said urn comprising:

a base having a wall defining an opening there through, the wall having an internal surface and an external surface, the wall defining a top edge, the base defining a cavity adapted to store ashes of a deceased; and a lid including a top surface and an integral catch for engagement with the base, the catch including an arm extending away from the top surface in a first direction and a protrusion extending from the arm in a second direction, the protrusion sized to fit into the opening to removably secure the lid to the base, the protrusion including a wall engaging surface for engaging the wall and an external surface protruding through the opening and having a length in a direction substantially normal to the top surface, the wall engaging surface having a width less than the length of the external surface;

wherein the opening of the wall is spaced from the top edge a distance at least three times the thickness of the wall.

2. The cremation urn of claim 1, wherein the external surface of the protrusion is adapted to contact a portion of the internal surface of the wall of the base as the lid is advanced from an open position to a closed position.

3. The cremation urn of claim 2, wherein the portion of the internal surface is skewed in relation to a corresponding portion of the outer surface such that the portion of the internal surface deflects the protrusion inwardly as the lid is advanced from an open position to a closed position.

4. The cremation urn of claim 2, wherein the arm includes a least one integrally formed reinforcement.

5. The cremation urn of claim 1, further comprising a living hinge extending from the lid to the base and opposed to the catch.

6. A cremation urn, said urn comprising:

a base having a wall defining an opening there through, the wall having an internal surface and an external surface, the wall defining a top edge, the base defining a cavity adapted to store ashes of a deceased; and a lid including a top surface and an integral catch for engagement with the base, the catch including an arm extending away from the top surface in a first direction and a protrusion extending from the arm in a second direction, the protrusion sized to fit into the opening to removably secure the lid to the base, the protrusion including a wall engaging surface for engaging the wall and an external surface protruding through the opening and having a length in a direction substantially normal to the top surface, the wall engaging surface having a width less than the length of the external surface;

wherein the catch includes a first portion including the arm extending from the top surface and a second portion extending from the first portion, the second portion including the external surface, the external surface including a portion that is skewed inward.

7. The cremation urn of claim 6, wherein the second portion includes the wall engaging surface, the wall engaging surface being substantially normal to a direction that the first portion extends from the top surface.

8. The cremation urn of claim 6 wherein the opening of the wall is spaced from the top edge a distance at least three times the thickness of the wall.

9. A cremation urn, said urn comprising:

a base having a wall, the wall having an inner surface and an opposed outer surface defining a thickness therebetween and the wall defining a top edge extending at least partly from the outer surface to the inner surface, the wall further defining an opening extending from the outer surface to the inner surface, the opening of the wall spaced from the top edge a distance at least three times the thickness of the wall, the base defining a cavity adapted to store ashes of a deceased; and a lid including a top, the lid including an integral catch extending from the periphery of the top, the catch including a protrusion sized to fit into the opening to selectively secure the lid to the base.

10. The cremation urn of claim 9, wherein the catch includes a first portion extending from the cover and a second portion extending from the first portion, the second portion including the protrusion.

11. The cremation urn of claim 10, wherein the protrusion includes a wall engaging surface, the wall engaging surface being substantially parallel to a main surface of the top of said lid.

12. The cremation urn of claim 10, wherein the second portion extends substantially parallel to the outer surface in a first direction, and wherein the protrusion has an outer surface having an end portion that extends in a direction having a component in the first direction and a component normal to the first direction.

13. The cremation urn of claim 12, wherein the end portion extends in an inclined manner.

14. The cremation urn of claim 9, wherein a portion of the base between the top edge and opening has a variable thickness.

15. The cremation urn of claim 14, wherein a portion of the protrusion has a variable thickness.

16. The cremation urn of claim 15, wherein the portion of the base and the portion of the protrusion cooperate during closure of the lid to urge the protrusion inward until the protrusion is disposed within or through the opening.

17. The cremation urn of claim 9, further comprising a living hinge extending from the lid to the base and opposed to the catch.

18. A cremation urn, said urn comprising:

a base having a wall defining an opening therethrough, the wall having an internal surface and an external surface and defining a thickness therebetween, the wall defining a top edge, the opening of the wall is spaced from the top edge a distance at least three times the thickness of the wall, the base defining a cavity adapted to store ashes of a deceased;

a lid including a cover for engagement with the base and an integral catch, the catch defining a protrusion extending from the cover and sized to fit into the opening to selectively secure the lid to the base, the protrusion including a wall engaging surface for engaging the wall and an external surface extending from the wall engaging surface in a direction opposed to the cover, the wall engaging surface having a width less than a length of the external surface in the direction opposed to the cover; and a living hinge extending from the lid to the base and opposed to the catch.

19. The cremation urn of claim 18, wherein the protrusion includes a first portion extending from the cover and a second portion extending from the first portion, the first portion including a surface adapted to closely conform to the internal surface of the base when the cover is in engagement with the base.

20. The cremation urn of claim 18, wherein the external surface of the protrusion is adapted to contact the internal surface of the wall of the base as the lid is advanced from an open position to a closed position, the internal surface of the wall deflecting the protrusion inwardly as the lid is advanced from an open position to a closed position so that the wall engaging surface of the protrusion may fitted into the opening of the base.

* * * * *